US011047547B2

(12) United States Patent
Jiang

(10) Patent No.: US 11,047,547 B2
(45) Date of Patent: Jun. 29, 2021

(54) STAGE LAMP OPTICAL SYSTEM HAVING BEAM AND PATTERN EFFECTS AND LIGHT PROJECTING DEVICE

(71) Applicant: Guangzhou Haoyang Electronic Co., Ltd., Guangdong (CN)

(72) Inventor: Weikai Jiang, Guangdong (CN)

(73) Assignee: Guangzhou Haoyang Electronic Co., Ltd.

( * ) Notice: Subject to any disclaimer, the term of this patent is extended or adjusted under 35 U.S.C. 154(b) by 0 days.

(21) Appl. No.: 16/705,484

(22) Filed: Dec. 6, 2019

(65) Prior Publication Data

US 2020/0109833 A1 Apr. 9, 2020

Related U.S. Application Data

(63) Continuation of application No. PCT/CN2018/089957, filed on Jun. 5, 2018.

(30) Foreign Application Priority Data

Jun. 8, 2017 (CN) ..... 201710427730.3

(51) Int. Cl.
*F21V 5/00* (2018.01)
*F21V 9/32* (2018.01)
(Continued)

(52) U.S. Cl.
CPC ..... *F21V 5/008* (2013.01); *F21V 5/04* (2013.01); *F21V 9/32* (2018.02); *F21V 14/08* (2013.01);
(Continued)

(58) Field of Classification Search
CPC ..... F21S 41/16; F21S 10/007; F21V 9/32; F21V 5/04; F21V 14/08; F21W 2131/406
See application file for complete search history.

(56) References Cited

U.S. PATENT DOCUMENTS

2013/0208479 A1 8/2013 Allan
2015/0092418 A1* 4/2015 Jurik ..... F21V 5/008 362/282
(Continued)

FOREIGN PATENT DOCUMENTS

CN 201180949 Y 1/2009
CN 102662301 A 9/2012
(Continued)

OTHER PUBLICATIONS

International Search Report for PCT/CN2018/089957 dated Aug. 22, 2018.
(Continued)

*Primary Examiner* — Rajarshi Chakraborty
*Assistant Examiner* — Michael Chiang
(74) *Attorney, Agent, or Firm* — Lerner, David, Littenberg, Krumholz & Mentlik, LLP

(57) ABSTRACT

The present invention discloses a stage lamp optical system having beam and pattern effects comprising a laser light source, a first light guide component, an LED light source, a second light guide component and a plurality of optical lens components, which are sequentially arranged along a main optical axis, wherein both the LED light source and the second light guide component are provided with an opening at a position directly facing the first light guide component; and after the light from the laser light source passes through the first light guide component or after the light from the LED light source passes through the second light guide component, the light sequentially passes through the plurality of optical lens components to form a light output in a beam mode or in a pattern mode.

18 Claims, 1 Drawing Sheet

(51) Int. Cl.

| | |
|---|---|
| ***F21V 5/04*** | (2006.01) |
| ***F21V 14/08*** | (2006.01) |
| *F21Y 115/10* | (2016.01) |
| *F21W 131/406* | (2006.01) |

(52) U.S. Cl.
CPC .... *F21W 2131/406* (2013.01); *F21Y 2115/10* (2016.08)

(56) References Cited

U.S. PATENT DOCUMENTS

| | | | | |
|---|---|---|---|---|
| 2017/0314753 | A1* | 11/2017 | Gammer | F21S 41/255 |
| 2019/0032878 | A1* | 1/2019 | Muster | F21S 41/18 |
| 2019/0049083 | A1* | 2/2019 | Groetsch | F21K 9/64 |
| 2019/0226654 | A1* | 7/2019 | Kauschke | F21S 41/141 |

FOREIGN PATENT DOCUMENTS

| | | | | | |
|---|---|---|---|---|---|
| CN | 103244898 | A | | 8/2013 | |
| CN | 204254492 | U | | 4/2015 | |
| CN | 204922832 | U | | 12/2015 | |
| CN | 205350946 | U | * | 6/2016 | F21V 9/30 |
| CN | 205350946 | U | | 6/2016 | |
| CN | 205640710 | U | | 10/2016 | |
| CN | 107228301 | A | | 10/2017 | |
| CN | 107606573 | A | | 1/2018 | |
| CN | 206918796 | U | | 1/2018 | |
| EP | 3392549 | A1 | * | 10/2018 | F21V 13/14 |
| EP | 3392549 | A1 | | 10/2018 | |
| WO | 2018171056 | A1 | | 9/2018 | |

OTHER PUBLICATIONS

Search from Chinese Office Action dated Jun. 26, 2019 for CN201710427730.3.

* cited by examiner

STAGE LAMP OPTICAL SYSTEM HAVING BEAM AND PATTERN EFFECTS AND LIGHT PROJECTING DEVICE

CROSS REFERENCE TO RELATED APPLICATIONS

The present application is a continuation of International Application No. PCT/CN2018/089957, filed Jun. 5, 2018, which claims priority from Chinese Patent Application No. 201710427730.3 filed Jun. 8, 2017, all of which are hereby incorporated herein by reference.

TECHNICAL FIELD

The present invention relates to the technical field of stage lamps, and more particularly to a stage lamp optical system having beam and pattern effects and a light projecting device.

BACKGROUND ART

With the improvement of people's living standards, the development of the cultural and entertainment industries has higher and higher requirement for the use of stage lamps. In order to achieve switching between a beam effect and a pattern effect of a stage lamp, there are usually two solutions, one of which is to switch light guide components on a light transfer axis, and the other is to switch positions of a light source. By either of the solutions, the stage lamp optical system has a relatively complicated structure, increasing manufacturing cost, with cumbersome operation for switching between the beam effect and the pattern effect.

SUMMARY OF THE INVENTION

The object of the present invention is to overcome the deficiencies of the prior art and provide a stage lamp optical system having beam and pattern effects, which is simple in structure, low manufacturing cost, and convenient to operate when switching between a beam effect and a pattern effect.

The present invention provides a stage lamp optical system having beam and pattern effects, comprising a laser light source, a first light guide component, an LED light source, a second light guide component and a plurality of optical lens components, which are sequentially arranged along a main optical axis, wherein both the LED light source and the second light guide component are provided with an opening at a position directly facing the first light guide component; and the light from the laser light source sequentially passes through the plurality of optical lens components to form a light output in beam mode, after passing through the first light guide component, or the light from the LED light source sequentially passes through the plurality of optical lens components to form a light output in a pattern mode, after passing through the second light guide component. The first light guide component is provided with phosphor, so that the laser light emitted from the laser light source can excite the phosphor to generate white light, and the light emitted from the LED light source passes through the second light guide component.

According to the present invention, the LED light source and the second light guide component are both provided with an opening in a position directly facing the first light guide component, so that the light emitted from the laser light source passes through the first light guide component and then sequentially passes through the plurality of optical lens components to form a light output in beam mode, and the light emitted from the LED light source passes through the second light guide component and then sequentially passes through the plurality of optical lens components to form a light output in pattern mode, realizing switching between abeam effect and a pattern effect by switching the action of the laser light source and the LED light source. Such stage lamp optical system thus is simple in structure, low manufacturing cost and convenient to operate when switching between the beam effect and the pattern effect. In addition, since the light output in beam mode is formed by the laser light source, the stage lamp optical system has a better beam effect.

Preferably, the light passing through the first light guide component and the second light guide component has the same focus. With such a configuration, the light emitted from the laser light source passing through the first light guide component can converge, together with LED light passing through the second light guide component, to a same focal plane so as to ensure the optimal beam effect and pattern effect out of the plurality of optical lens components.

Preferably, both the center of the beam of the laser light source and the center of the ring light source of the LED light source are located on the main optical axis.

Such a configuration not only facilitates the transfer of light, but also reduces the loss of light, so that the light can be used to the maximum to form light output in beam mode or in pattern mode.

Preferably, the diameter of a light output hole of the laser light source is L, and the diameter of the light output hole of the LED light source is $n \times L$, $n>1$.

Preferably, the plurality of optical lens components includes a first optical lens component, a second optical lens component and a third optical lens component, which are in sequential connection; and after the light from the laser light source passes through the first light guide component or after the light from the LED light source passes through the second light guide component, the light sequentially passes through the first optical lens component, the second optical lens component and the third optical lens component to form light output in beam mode or in pattern mode.

Preferably, the second light guide component is constituted by a lens.

Preferably, the first light guide component is constituted by a lens or a light guide, or the first light guide component is constituted by a combination of a lens and an array lens, or the first light guide component is constituted by a combination of a lens and a light guide.

Preferably, the first light guide component comprises a light collecting lens component and a converging lens component embedded in the opening; and phosphor for exciting laser light is provided on a phosphor plate being located between the light collecting lens component and the converging lens component. The light emitted from the laser light source is collected by the light collecting lens component and is then converged onto the phosphor in the phosphor plate to generate excited laser light, which is converged by the converging lens component and then forms a focal plane at the focal position; and the LED light is converged by the second light guide component, and the focal plane generated by the converged LED light is coplanar with the focal plane of the excited laser light.

The present invention further provides a stage lamp light projecting device having beam and pattern effects, using the above stage lamp optical system, wherein the stage lamp light projecting device further comprises a light blocking plate provided behind the plurality of optical lens components, the light blocking plate is provided with at least one pattern region, and each of the pattern regions has two patterns respectively corresponding to the laser light source and the LED light source; and the light from the laser light source and the light from the LED light source passing through the plurality of optical lens components project onto the light blocking plate to exhibit a shape corresponding to the pattern on the light blocking plate.

According to the present invention, each of the pattern regions has two patterns respectively corresponding to the laser light source and the LED light source, so that different patterns can be lighted to exhibit the corresponding shape through switching between different light sources. The stage lamp light projecting device having beam and pattern effects of the present invention is simple in structure, convenient to switch the projected beam shape and pattern shape, and the projected shape is not only determined by the pattern itself, but also controlled by the light source, thereby being more practical.

Preferably, the light blocking plate is provided with a driving device, which drives a plate body of the light blocking plate to rotate and enables the light blocking plate to be selectively in a position effectively blocking light or in a position not blocking light. Such a configuration facilitates accurately driving the light blocking plate to a specified position to switch between the patterns corresponding to the laser light source and the LED light source, thereby projecting different beam shapes and pattern shapes.

Preferably, the two patterns of each of the pattern regions include a pattern A and a pattern B in a nested distribution, and the light emitted from the laser light source project onto the light blocking plate to reflect a shape of the pattern A, and the light emitted from the LED light source project onto the light blocking plate to reflect a shape in combination of the pattern A and the pattern B. When it needs to reflect different shapes, it is only necessary to rotate the light blocking plate to make the corresponding pattern face with the corresponding light source, and then light the light source up.

Preferably, the pattern A is nested in the pattern B, and the size formed by the light, emitted from the laser light source, projecting onto the corresponding pattern matches the size of the corresponding pattern A; the size formed by the light, emitted from the LED light source, projecting onto the corresponding pattern matches the size of the corresponding pattern B; that is the light emitted from the laser light source project onto the light blocking plate to reflect the shape of the pattern A, the light emitted from the LED light source project onto the light blocking plate to reflect the shape in combination of the pattern A and the pattern B, or the light emitted from the laser light source and the LED light source project onto the light blocking plate to reflect the shape in combination of the pattern A and the pattern B. When the laser light source emits light, the laser light illuminates the pattern A to exhibit the shape of the pattern A and present a beam effect; and when the LED light source emits light, the light illuminates the pattern A and the pattern B at the same time, and thus can present the shape in combination of the pattern A and the pattern B.

Preferably, the pattern regions are spaced apart and surround the center of the light blocking plate. Such a configuration facilitates the rotation of the light blocking plate so that the light source corresponds to different patterns.

Preferably, the center of the beam of the laser light source and the center of the ring light source of the LED light source are coaxial with the center of the corresponding pattern. With such a configuration, when the light from the light source is emitted into the nested pattern, the light is distributed more uniformly, and thus the pattern is expressed more fully, clearly and uniformly.

Compared with the prior art, the present invention can obtain some beneficial effects.

According to the stage lamp optical system having beam and pattern effects of the present invention, by means of the LED light source and the second light guide component being provided with an opening in a position directly facing the first light guide component, the light emitted from the laser light source passes through the first light guide component and then sequentially passes through the plurality of optical lens components to form a light output in beam mode, and the light emitted from the LED light source passes through the second light guide component and then sequentially passes through the plurality of optical lens components to form a light output in pattern mode, so that the beam effect and the pattern effect can be switched by means of switching the action of the laser light source and the LED light source. The stage lamp optical system is simple in structure, low manufacturing cost and convenient to operate when switching between the beam effect and the pattern effect. In addition, since the laser light source is used to form the light output in beam mode, the stage lamp optical system according to the present invention has a better beam effect. Both the center of the beam of the laser light source and the center of the ring light source of the LED light source are arranged on the main optical axis, which not only facilitates the transfer of light, but also reduces the loss of light, so that the light can be used to the maximum to form the the light output in beam mode or in pattern mode. According to a stage lamp light projecting device having beam and pattern effects of the present invention, by means of providing two patterns respectively corresponding to the laser light source and the LED light source in each of the pattern regions, switching between different light sources can illuminate different patterns to exhibit the corresponding shape, such that a simple structure is achieved, the projected beam shape and the pattern shape can be switched conveniently, and the projected shape is not only determined by the pattern itself, but also controlled by the light source, thereby being more practical.

DETAILED DESCRIPTION OF EMBODIMENTS

Figure 1:
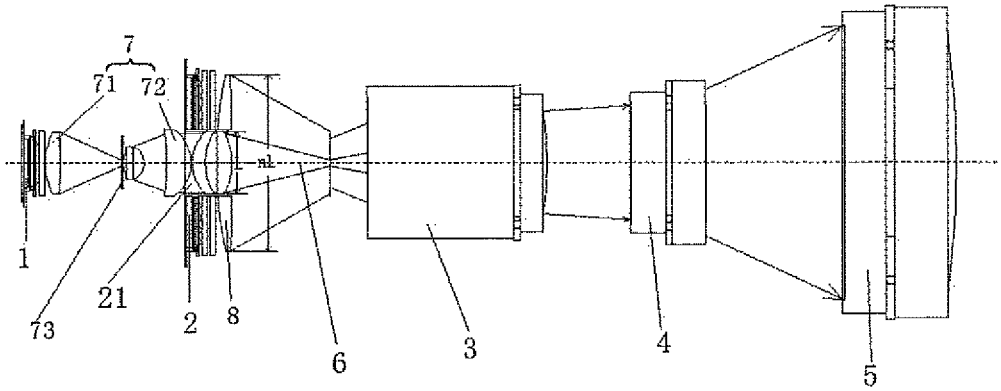
FIG. 1 is a structural schematic diagram of a stage lamp optical system having beam and pattern effects according to an embodiment.

The present invention will be further described in conjunction with specific embodiments. The drawings are used for illustrative purposes only, are merely schematic diagrams, rather than pictures of a real object, and are not to be construed as limiting this patent. In order to better illustrate the embodiments of the present invention, some components will be omitted, scaled up or scaled down in the drawings, which does not represent the size of the actual product. For those skilled in the art, it would have been appreciated that some well-known structures in the accompanying drawings and the illustration thereof could be omitted.

The same or similar reference numerals in the accompanying drawings of the embodiments of the present invention correspond to the same or similar components. In the description of the present invention, it is to be understood that if the orientation or positional relationship indicated by the terms "upper", "lower", "left", "right", etc. is based on the orientation or positional relationship shown in the drawings, which is intended to facilitate describing the present invention and simplifying the description only, rather than indicating or implying that a device or an element referred to must have a particular orientation or be configured and operated in a particular orientation, and therefore the terms used to describe the positional relationship in the drawings are for illustrative purposes only and are not to be construed as limiting the scope of this patent, and for those skilled in the art, the specific meaning of the above terms may be understood according to specific conditions.

Embodiment 1

A structural schematic diagram of a stage lamp optical system having beam and pattern effects according to the present embodiment is as shown in FIG. 1, comprising a laser light source 1, a first light guide component 7, an LED light source 2, a second light guide component 8 and a plurality of optical lens components, which are sequentially arranged along a main optical axis 6. Both the LED light source 2 and the second light guide component 8 are provided with an opening 21 in a position directly facing the first light guide component 7. After passing through the first light guide component 7, the light from the laser light source 1 sequentially passes through the plurality of optical lens components to form a light output in beam mode, or after passing through the second light guide component 8, the light from the LED light source 2 sequentially passes through the plurality of optical lens components to form a light output in pattern mode.

The main optical axis 6 does not actually exist, and in order to make the figure clear, the reference numerals are marked on the figure.

The first light guide component 7 is provided with phosphor, the laser light emitted from the laser light source 1 excites the phosphor to generate white light, and the light emitted from the LED light source 2 passes through the second light guide component 8.

In the present embodiment, the light passing through the first light guide component 7 and the light passing through the second light guide component 8 has the same focus. With such a configuration, the light emitted from the laser light source 1 passing through the first light guide component 7 can converge, together with LED light passing through the second light guide component 8, to a same focal plane so as to ensure the optimal beam effect and pattern effect out of the plurality of optical lens components.

When the stage lamp optical system is used, the laser light source 1 is turned on, and the LED light source 2 is turned off, such that the laser light emitted from the laser light source 1 is transferred onto the first light guide component 7 and excites the phosphor to generate white light, and the light passing through the first light guide component 7 sequentially passes through the plurality of optical lens components so as to form light output in beam mode; and the laser light source 1 is turned off, and the LED light source 2 is turned on, such that the light emitted from the LED light source 2 passes through the second light guide component 8 and sequentially passes through the plurality of optical lens components so as to form a light output in pattern mode. A stage lamp optical system having beam and pattern effects of the present embodiment is simple in structure, low manufacturing cost, and is more convenient to operate when switching between a beam effect and a pattern effect. In addition, since the laser light source is used to form the light output in beam mode, the stage lamp optical system has a better beam effect.

Both the center of the beam from the laser light source 1 and the center of a ring light source of the LED light source 2 are located on the main optical axis 6. Such a configuration not only facilitates the transfer of light, but also reduces the loss of light, so that the light can be used to the maximum to form the light output in beam mode or in pattern mode.

In addition, the diameter of a light output hole of the laser light source 1 is L, and the diameter of a light output hole of the LED light source 2 is $n \times L$, $n>1$.

The plurality of optical lens components includes a first optical lens component 3, a second optical lens component 4 and a third optical lens component 5, which are in sequential connection; and after the light from the laser light source 1 passes through the first light guide component or after the light from the LED light source 2 passes through the second light guide component, the light sequentially passes through the first optical lens component 3, the second optical lens component 4 and the third optical lens component 5 to form a light output in beam mode or in pattern mode.

In addition, the second light guide component 8 is constituted by a lens.

The first light guide component 7 is constituted by a lens or a light guide, or the first light guide component 7 is constituted by a combination of a lens and an array lens, or the first light guide component 7 is constituted by a combination of a lens and a light guide.

In this embodiment, the first light guide component 7 comprises a light collecting lens component 71 and a converging lens component 72 embedded in the opening 21; and phosphor for exciting laser light is provided on a phosphor plate 73 located between the light collecting lens component 71 and the converging lens component 72. The light emitted from the laser light source 1 is collected by the light collecting lens component 71 and is then converged onto the phosphor in the phosphor plate 73 to generate excited laser light, which is converged by the converging lens component 72 and then forms a focal plane at the focal position; and the LED light is converged by the second light guide component 8, and the focal plane generated by the converged LED light is coplanar with the focal plane of the excited laser light.

Embodiment 2

Figure 2:
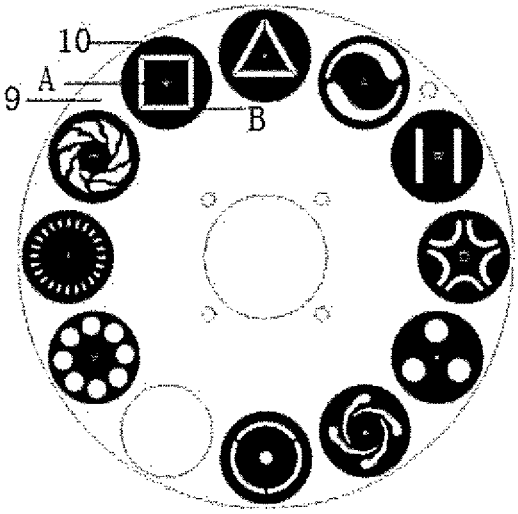
FIG. 2 is a structural schematic diagram of a light blocking plate according to the embodiment.
Figure 3:
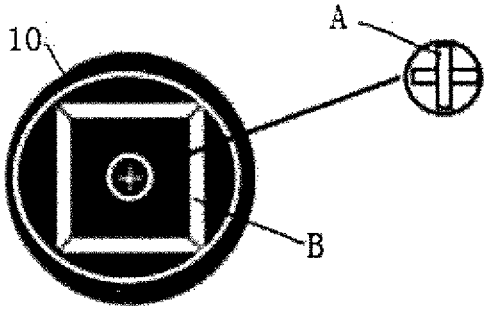
FIG. 3 is an enlarged schematic diagram of a pattern region of FIG. 2.

The present embodiment provides a stage lamp light projecting device having beam and pattern effects, using the stage lamp optical system according to the embodiment 1, the stage lamp light projecting device further comprises a light blocking plate 9 provided behind the plurality of optical lens components, wherein the light blocking plate 9 is provided with at least one pattern regions 10, and two patterns respectively corresponding to the laser light source 1 and the LED light source 2 are provided in each of the pattern regions 10; and the light from the laser light source 1 and the light from the LED light source 2 pass through the plurality of optical lens components and then project onto the light blocking plate 9 to exhibit a shape corresponding to the pattern on the light blocking plate 9. FIG. 2 is a structural schematic diagram of a light blocking plate 9, and FIG. 3 is an enlarged diagram of a pattern region 10.

In use, when the laser light source 1 or the LED light source 2 is turned on, the laser light or the LED light out of the plurality of optical lens components is irradiated on the corresponding pattern, such that the corresponding shape can be exhibited. A stage lamp light projecting device having beam and pattern effects of the present invention is simple in structure, convenient to switch the projected beam shape and pattern shape can be switched conveniently, and the projected shape is not only determined by the pattern itself, but also controlled by the light source, thereby being more practical.

The light blocking plate 9 is provided with a driving device, which drives a plate body of the light blocking plate 9 to rotate and enables the light blocking plate 9 to be selectively in a position effectively blocking light or in a position not blocking light. Such a configuration facilitates accurately driving the light blocking plate 9 to a specified position to switch between the patterns corresponding to the laser light source 1 and the LED light source 2, thereby projecting different beam shapes and pattern shapes.

In addition, the two patterns of each of the pattern regions 10 include a pattern A and a pattern B in a nested distribution, and the light emitted from the laser light source 1 project onto the light blocking plate to reflect a shape of the pattern A, and the light emitted from the LED light source 2 project onto the light blocking plate 9 to reflect the shape in combination of the pattern A and the pattern B. When it needs to reflect different shapes, it is only necessary to rotate the light blocking plate 9 to make the corresponding pattern face with the corresponding light source, and then light the light source up.

The pattern A is nested in the pattern B, and the size formed by the light, emitted from the laser light source 1, projecting onto the corresponding pattern matches the size of the corresponding pattern A; the size formed by the light, emitted from the LED light source 2, projecting onto the corresponding pattern matches the size of the corresponding pattern B. That is, the light emitted from the laser light source 1 project onto the light blocking plate 9 to reflect the shape of the pattern A, the light emitted from the LED light source 2 project onto the light blocking plate 9 to reflect the shape in combination of the pattern A and the pattern B, or the light emitted from the laser light source 1 and the LED light source 2 project onto the light blocking plate 9 to reflect the shape in combination of the pattern A and the pattern B. The present embodiment is illustrated by an enlarged pattern region 10 shown in FIG. 3, in which the pattern A is a square pattern, the pattern B is a cross pattern, the pattern A and the pattern B are respectively provided with an circumscribed circle, the pattern A is nested in the pattern B, and the center point of the pattern A coincides with the center point of the pattern B. When the laser light source 1 emits light, the laser light illuminates the pattern A to exhibit the shape of the pattern A and present a beam effect; when the LED light source 2 emits light, the LED light illuminates the pattern A and the pattern B at the same time, and thus can present the shape in combination of the pattern A and the pattern B; and when the laser light source 1 and the LED light source 2 emit light together, the laser light and the LED light simultaneously illuminate the pattern A and the pattern B, and thus can also present the shape in combination of the pattern A and the pattern B.

In addition, the pattern regions 10 are spaced apart and surround the center of the light blocking plate 9. The centers of the patterns in all of the pattern regions 10 are located on the circumference of the same circle. Such a configuration facilitates the rotation of the light blocking plate 9 so that the light source corresponds to different patterns so as to exhibit different shapes.

The center of the beam from the laser light source 1 and the center of the ring light source of the LED light source 2 are coaxial with the center of the corresponding pattern. With such a configuration, when the light from the light source is emitted into the nested pattern, the light is distributed more uniformly, and thus the pattern is expressed more fully, clearly and uniformly.

Obviously, the above embodiments of the present invention are merely embodiments used for clearly describing the present invention, instead of limiting the implementation modes of the present invention. For a person skilled in the art, other forms of changes or variations may also be made on the basis of the above illustration. There is no need and no way to exhaust all implementation modes here. Within the spirit and principle of the present invention, any modifications, equivalent replacements, improvements, etc., shall be comprised within the scope of protection of the present invention.

The invention claimed is:

1. A stage lamp light projecting device having beam and pattern effects, comprising a laser light source, a first light guide component, an LED light source, a second light guide component and a plurality of optical lens components, which are sequentially arranged along a main optical axis, wherein both the LED light source and the second light guide component are provided with an opening at a position directly facing the first light guide component; wherein the second light guide component is configured to converge the LED light, and wherein when the laser light source is on and the LED light source is off, the stage lamp optical system has light output in a beam mode after the laser light sequentially passed through the first light guide component and the plurality of optical lens components; and when the LED light source is on and the laser light source is off, the stage lamp optical system has light output in a pattern mode after the LED light sequentially passed through the second light guide component and the plurality of optical lens components, further comprising a light blocking plate provided behind the plurality of optical lens components, wherein the light blocking plate is provided with at least one pattern region, and each of the pattern region has two patterns respectively corresponding to the laser light source and the LED light source; and the light from the laser light source and the light from the LED light source passing through the plurality of optical lens components project onto the light blocking plate to exhibit a shape corresponding to the pattern on the light blocking plate, and wherein the two patterns in each of the pattern region include a pattern A and a pattern B in a nested distribution, the light emitted from the laser light source project onto the light blocking plate to reflect a shape of the pattern A; and the light emitted from the LED light source project onto the light blocking plate to project a shape in combination of the pattern A and the pattern B.

2. The stage lamp light projecting device according to claim 1, wherein the light passing through the first light guide component and the light passing through the second light guide component have same focus.

3. The stage lamp light projecting device according to claim 2, wherein a center of the beam from the laser light source and a center of a ring light source of the LED light source are both located on the main optical axis.

4. The stage lamp light projecting device according to claim 2, wherein a diameter of a light output hole of the laser light source is L, and a diameter of a light output hole of the LED light source is n×L, n>1.

5. The stage lamp light projecting device according to claim 2, wherein the plurality of optical lens components includes a first optical lens component, a second optical lens component and a third optical lens component, which are in sequential connection; and after the light from the laser light source passes through the first light guide component or after the light from the LED light source passes through the second light guide component, the light sequentially passes through the first optical lens component, the second optical lens component and the third optical lens component to form a light output in a beam mode or in a pattern mode.

6. The stage lamp light projecting device according to claim 2, wherein the second light guide component is constituted by a lens.

7. The stage lamp light projecting device according to claim 2, wherein the first light guide component is constituted by a lens or a light guide, or the first light guide component is constituted by a combination of a lens and an array lens, or the first light guide component is constituted by a combination of a lens and a light guide.

8. The stage lamp light projecting device according to claim 7, wherein the first light guide component comprises a light collecting lens component and a converging lens component embedded in the opening; and phosphor for exciting laser light is provided on a phosphor plate located between the light collecting lens component and the converging lens component.

9. The stage lamp light projecting device according to claim 1, wherein the light blocking plate is provided with a driving device, which drives a plate body of the light blocking plate to rotate and enables the light blocking plate to be selectively in a position effectively blocking light or in a position not blocking light.

10. The stage lamp light projecting device according to claim 1, wherein the pattern A is nested in the pattern B, and a size formed by the light, emitted from the laser light source, projecting onto the corresponding pattern matches a size of the corresponding pattern A; a size formed by the light, emitted from the LED light source, projecting onto the corresponding pattern matches a size of the corresponding pattern B; the light emitted from the laser light source project onto the light blocking plate to reflect the shape of the pattern A, and the light emitted from the LED light source project onto the light blocking plate to reflect the shape in combination of the pattern A and the pattern B; or the light emitted from the laser light source and the light emitted from the LED light source project onto the light blocking plate to reflect the shape in combination of the pattern A and the pattern B.

11. The stage lamp light projecting device according to claim 1, wherein the at least one pattern region are spaced apart and surround a center of the light blocking plate.

12. The stage lamp light projecting device according to claim 1, wherein the center of the beam from the laser light source and the center of the ring light source of the LED light source are coaxial with the center of the corresponding pattern.

13. A stage lamp light projecting device, comprising a blocking plate; and a laser light source and a LED light source, the laser light source and the LED light source being in a nested distribution, wherein the light blocking plate has at least one pattern region, each of the pattern region includes two patterns in a nested distribution, the two patterns are configured to correspond to the two light sources, and size of light output of each light source projected on the light blocking plate matches size of the corresponding pattern, when the light output of the laser light source projects onto the light blocking plate, a shape of the corresponding pattern thereof is reflected; when the light output of the LED light source projects onto the light blocking plate, a shape in combination of the two patterns is reflected; and when the light output of the laser light source and the LED light source simultaneously project onto the light blocking plate, a shape in combination of the two patterns is reflected.

14. The stage lamp light projecting device according to claim 13, wherein the light blocking plate is provided with a driving device, which drives a plate body of the light blocking plate to rotate and enables the light blocking plate to be selectively in a position effectively blocking light or in a position not blocking light.

15. The stage lamp light projecting device according to claim 13, further comprising a first light guide component, a second light guide component and a plurality of optical lens components, wherein the laser light source, the first light guide component, the LED light source, the second light guide component, the plurality of optical lens components and the blocking plate are sequentially arranged along a main optical axis, and wherein both the LED light source and the second light guide component are provided with an opening at a position directly facing the first light guide component.

16. The stage lamp light projecting device according to claim 15, wherein the light passing through the first light guide component and the light passing through the second light guide component have same focus, and wherein a center of the beam from the laser light source and a center of a ring light source of the LED light source are both located on the main optical axis.

17. The stage lamp light projecting device according to claim 15, wherein a diameter of a light output hole of the laser light source is L, and a diameter of a light output hole of the LED light source is n×L, n>1.

18. The stage lamp light projecting device according to claim 15, wherein the second light guide component is constituted by a lens.

* * * * *